US007077160B1

(12) United States Patent
Ratz

(10) Patent No.: US 7,077,160 B1
(45) Date of Patent: Jul. 18, 2006

(54) WATER PRESSURE PUMP

(76) Inventor: Werner K. Ratz, 6087 Featherhead Crescent, Mississauga, ON (CA) L5N 2B5

( * ) Notice: Subject to any disclaimer, the term of this patent is extended or adjusted under 35 U.S.C. 154(b) by 289 days.

(21) Appl. No.: 10/641,712

(22) Filed: Aug. 15, 2003

(51) Int. Cl.
*E03B 5/00* (2006.01)
*F04B 41/06* (2006.01)

(52) U.S. Cl. ..... 137/565.33; 137/565.35; 417/4

(58) Field of Classification Search ..... 137/563, 137/565.29, 565.33, 565.35; 417/4
See application file for complete search history.

(56) References Cited

U.S. PATENT DOCUMENTS 233,594 A * 10/1880 Beach ..... 137/565.35
1,304,529 A * 5/1919 Arnold ..... 137/565.33
1,904,320 A * 4/1933 Marples ..... 137/565.35
2,095,243 A * 10/1937 Diescher ..... 137/565.33
3,135,282 A * 6/1964 Gray ..... 137/565.33
3,198,121 A * 8/1965 Schaub ..... 417/4
3,286,636 A * 11/1966 Schaub ..... 137/565.33
3,357,359 A * 12/1967 Schaub ..... 137/565.33
3,746,027 A * 7/1973 Elliott ..... 137/565.35
2004/0103944 A1 * 6/2004 Shaw ..... 137/565.35

* cited by examiner

*Primary Examiner*—John Rivell

(57) ABSTRACT

An apparatus for boosting residential water pressure. To attain this, a conduit receives water supplied to a residence and routes the water through and inlet on/off valve and a first check valve to a pump, where said pump provides water to the residence as well as to a throttling conduit back to the input of the pump. In an embodiment, the water is returned to the input of the pump through a relief valve arranged within the throttling conduit. In an embodiment, a pressure switch provides input to a motor controlling the pump. Also, a method to increase water pressure.

16 Claims, 1 Drawing Sheet

WATER PRESSURE PUMP

BACKGROUND OF THE INVENTION

1. Field of the Invention

The present invention relates to a booster water pressure pump for use in connection with increasing a home's water pressure. The booster water pressure pump has particular utility for ensuring constant water pressure even during multiple in-home water uses.

2. Description of the Related Art

Water pumps are desirable providing water to a point of use.

The use of water pumps is known in the prior art. For example, U.S. Pat. No. 3,768,925 to Klemm discloses a pump arrangement for consumer apparatus.

U.S. Pat. No. 3,639,081 to Gray et al. discloses a liquid pressure booster system with cutoff for minimum flow levels. However, the Gray et al. '081 patent does not include a supply conduit, a residential conduit, a first pump having a first inlet conduit connected with said supply conduit, an outlet conduit connected with said residential conduit, a first motor for driving said first pump, a first check valve in said first inlet conduit, a throttling conduit connecting said first inlet conduit to said outlet conduit downstream of said first check valve, and a pressure switch connected with said residential conduit and transmitting a start signal for starting said first motor when the pressure in said residential conduit is less than a predetermined minimum pressure so that said first pump discharges into said residential conduit while circulating fluid through said throttling conduit as recited in the instant application.

Similarly, U.S. Pat. No. 3,369,489 to Schaub discloses a water pressure booster system that combines a hydro-pneumatic tank with multiple mechanical pumps. However, the Schaub '489 patent does not include a supply conduit, a residential conduit, a first pump having a first inlet conduit connected with said supply conduit, an outlet conduit connected with said residential conduit, a first motor for driving said first pump, a first check valve in said first inlet conduit, a throttling conduit connecting said first inlet conduit to said outlet conduit downstream of said first check valve, and a pressure switch connected with said residential conduit and transmitting a start signal for starting said first motor when the pressure in said residential conduit is less than a predetermined minimum pressure so that said first pump discharges into said residential conduit while circulating fluid through said throttling conduit as recited in the instant application.

U.S. Pat. No. 5,941,690 to Lin discloses a constant pressure variable speed inverter control booster pump system. However, the Lin '690 patent does not include a supply conduit, a residential conduit, a first pump having a first inlet conduit connected with said supply conduit, an outlet conduit connected with said residential conduit, a first motor for driving said first pump, a first check valve in said first inlet conduit, a throttling conduit connecting said first inlet conduit to said outlet conduit downstream of said first check valve, and a pressure switch connected with said residential conduit and transmitting a start signal for starting said first motor when the pressure in said residential conduit is less than a predetermined minimum pressure so that said first pump discharges into said residential conduit while circulating fluid through said throttling conduit as recited in the instant application.

U.S. Pat. No. 4,290,735 to Sulko discloses a water pressure booster system that includes multiple large high capacity pumps arranged in parallel. However, the Sulko '735 patent does not include a supply conduit, a residential conduit, a first pump having a first inlet conduit connected with said supply conduit, an outlet conduit connected with said residential conduit, a first motor for driving said first pump, a first check valve in said first inlet conduit, a throttling conduit connecting said first inlet conduit to said outlet conduit downstream of said first check valve, and a pressure switch connected with said residential conduit and transmitting a start signal for starting said first motor when the pressure in said residential conduit is less than a predetermined minimum pressure so that said first pump discharges into said residential conduit while circulating fluid through said throttling conduit as recited in the instant application.

Lastly, U.S. Pat. No. 4,165,951 to Friedman et al. discloses a water pressure booster system and control valve therefore that regulates the pressure in a distribution system via a closely balanced piston valve. However, the Friedman '951 patent does not include a supply conduit, a residential conduit, a first pump having a first inlet conduit connected with said supply conduit, an outlet conduit connected with said residential conduit, a first motor for driving said first pump, a first check valve in said first inlet conduit, a throttling conduit connecting said first inlet conduit to said outlet conduit downstream of said first check valve, and a pressure switch connected with said residential conduit and transmitting a start signal for starting said first motor when the pressure in said residential conduit is less than a predetermined minimum pressure so that said first pump discharges into said residential conduit while circulating fluid through said throttling conduit as recited in the instant application.

While the above-described devices fulfill their respective, particular objectives and requirements, the aforementioned patents do not describe a booster water pressure pump that allows the increase of residential water pressure via the aforementioned configuration. The Klemm '925 patent makes no provision for including a supply conduit, a residential conduit, a first pump having a first inlet conduit connected with said supply conduit, an outlet conduit connected with said residential conduit, a first motor for driving said first pump, a first check valve in said first inlet conduit, a throttling conduit connecting said first inlet conduit to said outlet conduit downstream of said first check valve, and a pressure switch connected with said residential conduit and transmitting a start signal for starting said first motor when the pressure in said residential conduit is less than a predetermined minimum pressure so that said first pump discharges into said residential conduit while circulating fluid through said throttling conduit as recited in the instant application.

Therefore, a need exists for a new and improved booster water pressure pump which can be used for increasing residential water pressure without the limitations of the prior art. In this regard, the present invention substantially fulfills this need. In this respect, the booster water pressure pump according to the present invention substantially departs from the conventional concepts and designs of the prior art, and in doing so provides an apparatus primarily developed for the purpose of increasing water pressure.

SUMMARY OF THE INVENTION

In view of the foregoing disadvantages inherent in the known types of water pumps now present in the prior art, the present invention provides an improved booster water pressure pump, and overcomes the above-mentioned disadvantages and drawbacks of the prior art. As such, the general purpose of the present invention, which will be described subsequently in greater detail, is to provide a new and improved booster water pressure pump and method of increasing water pressure which has all the advantages of the prior art mentioned heretofore and many novel features that result in a booster water pressure pump which is not anticipated, rendered obvious, suggested, or even implied by the prior art, either alone or in any combination thereof.

This invention was conceived to boost water pressure in homes. Where at times water pressure from the city or township is insufficient to supply increased water usage in a private dwelling.

With the increase of home construction within the cities or townships limits, water demand is on the rise. At times increased usage will drop city pressure to where it may or could interfere with daily needs of residential water customers, which include, for example, showering, flushing of toilets, or merely watering the lawn.

This invention was designed to boost or equalize the water pressure in a home to meet demand. When installed, this system will sense pressure drops in the water system by means of a pressure sensor and regulator on the output line of the system. When engaged, the system will increase water flow to meet household needs. The system is also designed to disengage when demand is met or when water is not being used. The system is also equipped with an adjustable pressure relief valve.

To attain this, the present invention essentially comprises a supply conduit, a residential conduit, a first pump having a first inlet conduit connected with the supply conduit, an outlet conduit connected with the residential conduit, a first motor for driving the first pump, a first check valve in the first inlet conduit, a throttling conduit connecting the first inlet conduit to the outlet conduit downstream of the first check valve, and a pressure switch connected with the residential conduit and transmitting a start signal for starting the first motor when the pressure in the residential conduit is less than a predetermined minimum pressure so that the first pump discharges into the residential conduit while circulating fluid through the throttling conduit. Also, the invention includes a method for increasing residential water pressure.

There has thus been outlined, rather broadly, the more important features of the invention in order that the detailed description thereof that follows may be better understood and in order that the present contribution to the art may be better appreciated.

The invention may also include additional valves. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved booster water pressure pump that has all of the advantages of the prior art water pumps and none of the disadvantages.

It is another object of the present invention to provide a new and improved booster water pressure pump that may be easily and efficiently manufactured and marketed.

An even further object of the present invention is to provide a new and improved booster water pressure pump that has a low cost of manufacture with regard to both materials and labor, and which accordingly is then susceptible of low prices of sale to the consuming public, thereby making such booster water pressure pump economically available to the buying public.

Still another object of the present invention is to provide a new booster water pressure pump that provides in the apparatuses and methods of the prior art some of the advantages thereof, while simultaneously overcoming some of the disadvantages normally associated therewith.

Even still another object of the present invention is to provide a booster water pressure pump for non-residential applications.

Lastly, it is an object of the present invention to provide a new and improved method of increasing residential water pressure.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description males reference to the annexed drawings wherein.

The same reference numerals refer to the same parts throughout the various figures.

Figure 1:
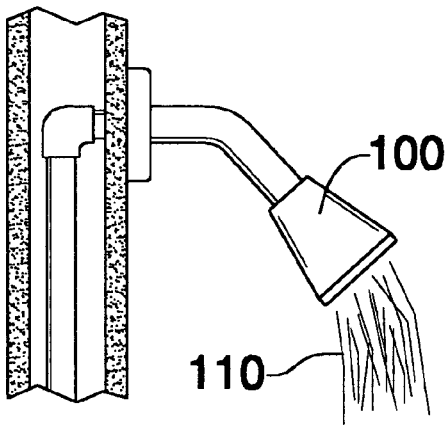
FIG. 1 is a side view of a water fixture as it may appear without the benefit of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Figure 2:
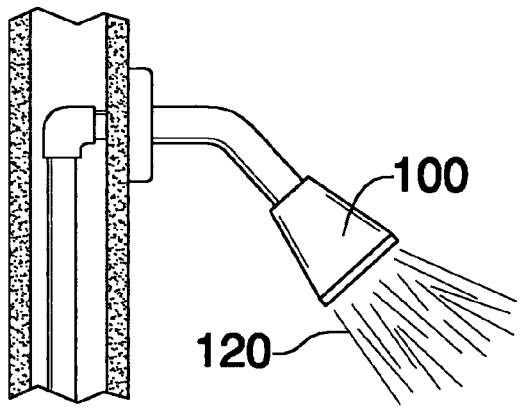
FIG. 2 is a side view of a water fixture as it may appear with the benefit of the present invention.
Figure 3:
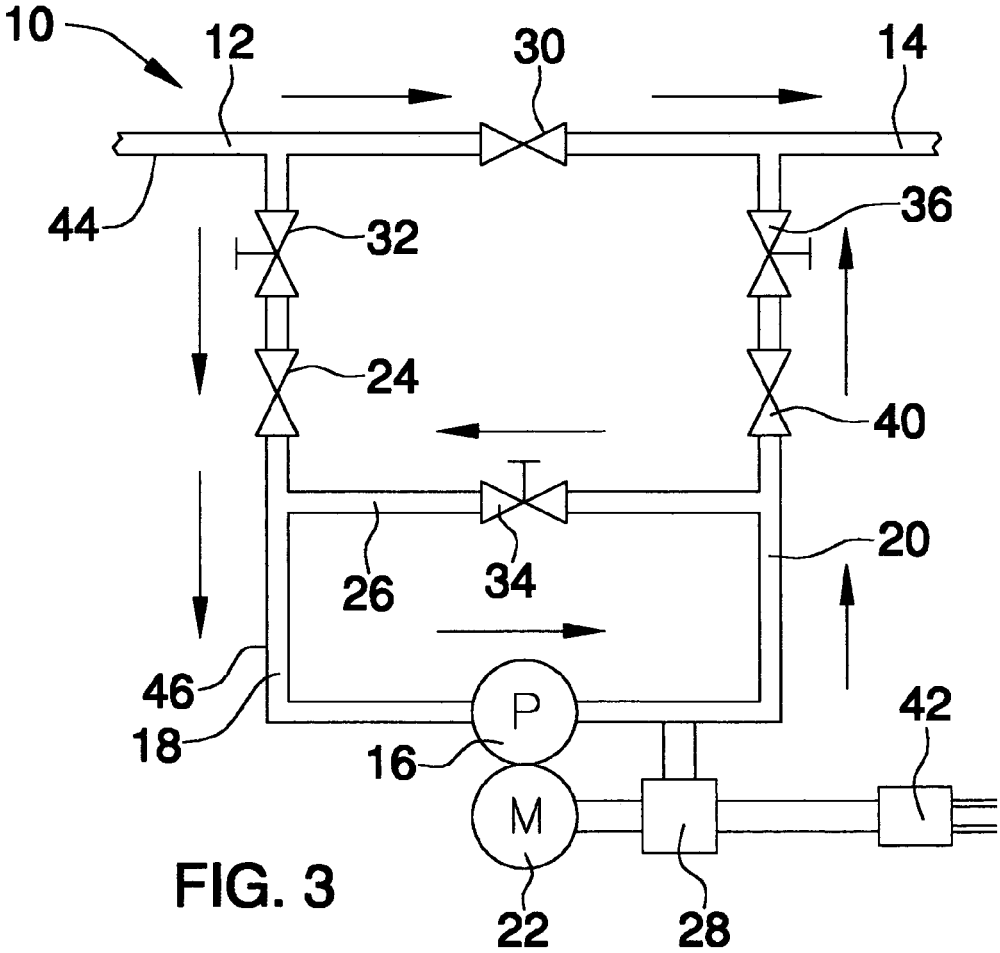
FIG. 3 is a schematic view of an embodiment of the apparatus of the present invention.

Referring now to the drawings, and particularly to FIGS. 1–3, a preferred embodiment of the booster water pressure pump of the present invention is shown and generally designated by the reference numeral 10.

In FIG. 1, a water fixture 100 is shown. Such a typical water fixture may be found in a typical household. In FIG. 1, the water fixture is shown having a low water flow 110. The apparatus herein described may remedy such a low flow. Once remedied, as shown in FIG. 2, the water fixture 100 delivers water having a boosted flow 120.

As shown in FIG. 3, a new and improved booster water pressure pump apparatus 10 of the present invention for boosting residential water pressure is illustrated and will be described. More particularly, the improved booster water pressure pump apparatus includes a water supply conduit 12. Water supply conduit 12 has a diameter 44. Supply conduit 12 provides water flow to an inlet conduit 18. Inlet conduit 18 has a diameter 46, where the supply conduit diameter 44 may be greater than or equal to the inlet diameter 46. Inlet conduit 18 provides water flow to pump 16. Pump 16 is driven by motor 22. Motor 22 is actuated by pressure switch 28. In an embodiment, motor 22 is actuated when the water pressure falls below a user-defined lower limit. In an embodiment, a water pressure less than or equal to 65 psi will cause the pressure switch 28 to switch, thus actuating motor 22. In this manner, the pump 16 may be turned on. IN an embodiment, pump 16 is a jet-type pump. The pressure switch 28 and first motor 22 are powered from a typical household electrical system, such as a 115/230 V system. For example, a typical household receptacle using power cord 42 may be used to power the apparatus. In an embodiment, pressure switch 28 is adjustable.

Water thus flows from the inlet conduit 18, through pump 16, and into the outlet conduit 20. In the event the water pressure is above the predetermined minimum pressure, the pump 16 is merely "open" and does not accelerate nor hinder water flow therethrough. However, when the water pressure is less than the predetermined minimum pressure, the pressure switch 28 is actuated, and thus the pump 16 is turned on. The pump increases the water flow from the apparatus 10 thus increasing the pressure of the water exiting the apparatus through outlet conduit 20.

A throttling conduit 26 is arranged between the inlet conduit 46 and the outlet conduit 20, in an arrangement substantially parallel to the pump 16 as shown. Thus, water may flow through the throttling conduit 26 when the relief valve 34 arranged within the throttling conduit 26 is open. In an embodiment, relief valve 34 is adjustable.

Arranged within the inlet conduit 18 is an inlet on/off valve 32. Such a valve may be used in enabling the apparatus 10. Correspondingly, arranged within the outlet conduit 20 is an outlet on/off valve 36. When these valves are turned to their "on" positions, the apparatus is enabled. That is, water may flow through the apparatus. The apparatus is disabled when the valves are turned "off".

Also arranged within the inlet conduit 18 is a first check valve 24. In an embodiment, check valve 24 is a spring type check valve. Check valve 24 prevents water from flowing into the supply conduit 12 from the first inlet conduit 18. Correspondingly, a third check valve 40 is arranged in the outlet conduit 20. A second check valve 30 is arranged between the supply conduit 12 and the residential conduit 14. In an embodiment, check valve 30 is a spring-type check valve.

In an embodiment, the apparatus will comprise pvc piping to ensure low cost and an apparatus that is substantially lightweight such that it may easily be transported. However, any suitably rigid, potable-water transporting conduit may be employed.

While a preferred embodiment of the booster water pressure pump has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable conduit material may be used instead of the PVC described. For example, copper or steel may be used. Also, other means of preventing water from back flowing into the supply conduit may be employed instead of the check valves recited herein. Still further, the apparatus may include quick-release fittings such that the apparatus may be easily installed and uninstalled. Such fittings may reside on the inlet and outlet conduits.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water pump apparatus for residential applications comprising:

a supply conduit;

a residential conduit;

a first pump having a first inlet conduit connected with said supply conduit;

an outlet conduit connected with said residential conduit;

a first motor for driving said first pump;

a first check valve in said first inlet conduit;

a throttling conduit connecting said first inlet conduit to said outlet conduit downstream of said first check valve;

a third check valve in said outlet conduit downstream of said throttling conduit; and a pressure switch connected with said residential conduit and transmitting a start signal for starting said first motor when the pressure in said residential conduit is less than a predetermined minimum pressure so that said first pump recirculates fluid through said throttling conduit until said third check valve opens responsive to a predetermined minimum pressure being established upstream of said third check valve, thereby permitting said fluid to discharge into said residential conduit.

2. The apparatus as recited in claim 1, further comprising a second check valve, wherein the second check valve is arranged between said supply conduit and said residential conduit.

3. The apparatus as recited in claim 1, further comprising an inlet on/off valve between said supply conduit and said first check valve.

4. The apparatus as recited in claim 1, further comprising a relief valve arranged within said throttling conduit.

5. The apparatus as recited in claim 1, further comprising an outlet on/off valve between said outlet conduit and said residential conduit.

6. The apparatus as recited in claim 2, further comprising an inlet on/off valve between said supply conduit and said first check valve.

7. The apparatus as recited in claim 2, further comprising a relief valve arranged within said throttling conduit.

8. The apparatus as recited in claim 2, further comprising an outlet on/off valve between said outlet conduit and said residential conduit.

9. The apparatus as recited in claim 6, further comprising a relief valve arranged within said throttling conduit.

10. The apparatus as recited in claim 9, further comprising an outlet on/off valve between said outlet conduit and said residential conduit.

11. The apparatus as recited in claim 3, wherein the inlet on/off valve comprises a manual flow control valve.

12. The apparatus as recited in claim 11, further comprising an outlet on/off valve between said outlet conduit and said residential conduit.

13. The apparatus as recited in claim 12, wherein said outlet on/off valve comprises a manual flow control valve.

14. The apparatus as recited in claim 1, wherein said supply conduit comprises a first diameter, and wherein said inlet conduit comprises a second diameter, and wherein said first diameter is greater than said second diameter.

15. The apparatus as recited in claim 1, wherein said predetermined minimum pressure is 65 psi.

16. A water pump apparatus for residential applications comprising:

a supply conduit;

a residential conduit;

a first pump having a first inlet conduit connected with said supply conduit;

an outlet conduit connected with said residential conduit;

a first motor for driving said first pump;

a first check valve in said first inlet conduit;

a throttling conduit connecting said first inlet conduit to said outlet conduit downstream of said first check valve;

a third check valve in said outlet conduit downstream of said throttling conduit;

a pressure switch connected with said residential conduit and transmitting a start signal for starting said first motor when a water pressure in said residential conduit is less than a predetermined minimum pressure such that said first pump recirculates water through said throttling conduit until said third check valve opens responsive to a predetermined minimum pressure being established upstream of said third check valve, thereby permitting said fluid to discharge into said residential conduit;

a second check valve, wherein said second check valve is arranged between said supply conduit and said residential conduit;

an inlet on/off valve between said supply conduit and said first check valve;

a relief valve arranged within said throttling conduit; and an outlet on/off valve between said outlet conduit and said residential conduit.

* * * * *